US006955731B2

(12) United States Patent
Waldock

(10) Patent No.: US 6,955,731 B2
(45) Date of Patent: Oct. 18, 2005

(54) EXPLOSIVE COMPOSITION, METHOD OF MAKING AN EXPLOSIVE COMPOSITION, AND METHOD OF USING AN EXPLOSIVE COMPOSITION

(76) Inventor: Kevin H. Waldock, 478 Putty Rd., Singleton (AU), 2330

( * ) Notice: Subject to any disclaimer, the term of this patent is extended or adjusted under 35 U.S.C. 154(b) by 0 days.

(21) Appl. No.: 10/248,550

(22) Filed: Jan. 28, 2003

(65) Prior Publication Data

US 2004/0144456 A1 Jul. 29, 2004

(51) Int. Cl.[7] ..... C06B 31/28; D03D 23/00
(52) U.S. Cl. ..... 149/46; 149/109.6
(58) Field of Search ..... 149/46, 109.6

(56) References Cited

U.S. PATENT DOCUMENTS

| | | | | |
|---|---|---|---|---|
| 3,356,547 A | | 12/1967 | Berthmann et al. | 149/51 |
| 3,522,117 A | | 7/1970 | Atadan et al. | 149/60 |
| 3,674,578 A | | 7/1972 | Cattermole et al. | 149/2 |
| 3,770,522 A | | 11/1973 | Tomic | 149/2 |
| 4,008,108 A | | 2/1977 | Chrisp | 149/2 |
| 4,111,727 A | | 9/1978 | Clay | 149/2 |
| 4,128,442 A | | 12/1978 | Barlow | 149/46 |
| 4,138,281 A | | 2/1979 | Olney et al. | 149/2 |
| 4,287,010 A | | 9/1981 | Owen, II | 149/2 |
| 4,322,258 A | | 3/1982 | Sudweeks et al. | 149/2 |
| 4,343,663 A | | 8/1982 | Breza, deceased et al. | 149/4 |
| 4,364,782 A | | 12/1982 | Funk et al. | 149/21 |
| 4,394,199 A | | 7/1983 | Barnhard, IV et al. | 149/21 |
| 4,404,050 A | | 9/1983 | Yorke et al. | 149/2 |
| 4,410,378 A | | 10/1983 | Hattori et al. | 149/109.6 |
| 4,420,349 A | | 12/1983 | Bampfield | 149/2 |
| 4,435,232 A | | 3/1984 | Ciaramitaro et al. | 149/2 |
| 4,461,660 A | | 7/1984 | Binet et al. | 149/2 |
| 4,470,855 A | | 9/1984 | Bampfield | 149/2 |
| 4,472,215 A | | 9/1984 | Binet et al. | 149/109.6 |
| 4,491,489 A | | 1/1985 | Ellis et al. | 149/109.6 |
| 4,506,990 A | | 3/1985 | Neier et al. | 366/299 |
| 4,507,161 A | | 3/1985 | Sujansky et al. | 149/21 |
| 4,511,412 A | | 4/1985 | Kakino et al. | 149/109.6 |
| 4,511,414 A | | 4/1985 | Matsui et al. | 149/109.6 |
| 4,547,232 A | | 10/1985 | Cartwright | 149/2 |
| 4,566,919 A | | 1/1986 | Jessop | 149/20 |
| 4,594,118 A | | 6/1986 | Curtin et al. | 149/2 |
| 4,614,146 A | * | 9/1986 | Ross et al. | 366/40 |
| 4,875,950 A | | 10/1989 | Waldock et al. | 149/21 |
| 4,957,569 A | | 9/1990 | Waldock et al. | 149/21 |
| 5,409,556 A | | 4/1995 | Lownds | 149/2 |
| 6,113,715 A | | 9/2000 | Halander et al. | 149/109.6 |

FOREIGN PATENT DOCUMENTS

| | | |
|---|---|---|
| AU | 106877 | 3/1939 |
| AU | 110850 | 3/1941 |
| AU | 146182 | 1/1951 |
| AU | 166372 | 5/1953 |
| AU | 598130 | 12/1988 |
| AU | 621083 | 8/1989 |
| AU | 621994 | 9/1990 |
| AU | 661802 | 8/1995 |
| CA | 888102 | 12/1971 |
| CA | 1020358 | 11/1977 |

OTHER PUBLICATIONS

B.H. Cintra, "Modern Blasting Practices in Brazil", Complete Abstracts of the ISEE Proceedings: 1985 General Proceedings Collection, pp. 1–13, International Society of Explosives Engineers, Cleveland, USA.

B.O. Juliano, "Chapter 19: Rice Hull and Rice Straw", Rice Chemistry and Technology, 1985, pp. 689–755, Eagan Press, United Kingdom.

* cited by examiner

*Primary Examiner*—Aileen Felton
(74) *Attorney, Agent, or Firm*—Holland & Hart LLP; Christopher J. Kulish, Esq.

(57) ABSTRACT

An explosive composition is provided that is comprised of a Heavy ANFO and grain hulls. In one embodiment, the grain hulls are comprised of rice hulls. The grain hulls serve both as an inert bulking additive that reduces the density of the composition and as a sensitizer that reduces the energy needed to reliably detonate the composition. Also provided is a method for manufacturing an explosive composition comprised of Heavy ANFO and grain hulls, such as rice hulls. Additionally, a method of using an explosive comprised of ANFO and grain hulls in a mining operation is disclosed.

4 Claims, No Drawings

EXPLOSIVE COMPOSITION, METHOD OF MAKING AN EXPLOSIVE COMPOSITION, AND METHOD OF USING AN EXPLOSIVE COMPOSITION

FIELD OF THE INVENTION

The present invention relates to an explosive composition that comprises Heavy ANFO, a method for making the explosive composition, and a method for using the explosive composition.

BACKGROUND OF THE INVENTION

For many years, one of the most popular explosives for use in mining operations has been ammonium nitrate fuel oil ("ANFO"), which is formed of porous ammonium nitrate prills and diesel oil that is situated within the voids of the porous ammonium nitrate prills. In mining operations, the use of ANFO typically involves drilling a blast hole in the earth that is being mined. After a blast hole has been drilled, one or more initiators and ANFO are loaded into the blast hole. The ANFO is then detonated with the result being that the earth that is being mined is fractured in a manner that facilitates the removal of the earth by machinery for further processing. Typically, an array of blast holes is established and the ANFO established in the blast holes is detonated simultaneously or in a sequence that is designed to produce desired blast characteristics.

A drawback associated with ANFO is that it is highly absorbent and the absorption of water reduces the explosive capability of the ANFO. Consequently, ANFO is typically not used in situations in which water in a blast hole is likely to adversely affect the ANFO. The water can be water that is present in the blast hole when the ANFO is loaded and/or water that migrates into the blast hole after the ANFO has been loaded and before the ANFO is detonated. Due to ANFO's highly absorbent nature, ANFO is suitable for use in applications in which water is unlikely to meaningfully reduce the effectiveness of the ANFO. Additionally, when Ammonium Nitrate is mixed with Fuel Oil to form ANFO, the resulting composition is dry to the touch and, as a consequence, commonly referred to as a "Dry Mix" explosive.

To address the "wet blast hole" situation, a water resistant ANFO, commonly referred to as Heavy ANFO, was developed. Heavy ANFO is comprised of an emulsion explosive in combination with ANFO and/or ammonium nitrate prills. An emulsion explosive contains oxidizers that are dissolved in water droplets that are surrounded by an immiscible fuel, such as oil. Due to Heavy ANFO's water resistance, it is suitable for use in applications in which the composition will be exposed or is likely to be exposed to water. Additionally, Heavy ANFO is wet to the touch due to the interstices of the ammonium nitrated being filled within the ammonium nitrate with the emulsion explosive. Hence, Heavy ANFO is sometimes referred to as "wet mix" explosive.

In addition to water resistance, a given volume of Heavy ANFO has greater explosive energy than an equal volume of ANFO. In a mining situation, the greater explosive energy of Heavy ANFO per unit volume typically means that fewer blast holes need to be drilled to blast a particular area relative to the number of blast holes that need to be drilled when ANFO is used. Further, for a given explosive energy, the cost to produce Heavy ANFO is less than the cost to produce ANFO in many situations. Due to the increased explosive energy and reduced cost, Heavy ANFO is also utilized in dry blast hole situations.

A problem associated with Heavy ANFO is that the density of the Heavy ANFO in a blast hole increases with increasing depth in the blast hole. Stated differently, there is a density gradient for the Heavy ANFO in a blast hole. As the density of Heavy ANFO increases, the sensitivity of the Heavy ANFO decreases. Sensitivity is a measure of the amount of energy needed to reliably detonate an explosive. So, a more sensitive explosive requires less energy to detonate than a less sensitive explosive. Consequently, in a blast hole, the Heavy ANFO towards the bottom of the blast hole may be much less sensitive than the Heavy ANFO towards the top of the blast hole. This sensitivity gradient can produce asymmetrical or uneven detonations that fail to have the desired blast characteristics.

To address the density problem in Heavy ANFO, a number of solutions have been proposed. For instance, inert bulking agents in the form of certain agricultural waste products have been added to the Heavy ANFO. However, the agricultural waste products presently known to be used to reduce the density also reduce the sensitivity of the explosive, in many cases, to the point at which the explosive is ineffective. Another approach replaces some or all of the fuel oil in the Heavy ANFO with polystyrene. However, this approach also reduces the sensitivity of the explosive and is generally cost prohibitive. Yet another approach uses microballoons and/or perlite, which are known sensitizing agents, to decrease the density of the Heavy ANFO. This approach is not presently considered cost effective. A further approach uses chemical gassing to reduce the density. The drawback of this approach is that the density cannot be effectively controlled over a wide density range.

SUMMARY OF THE INVENTION

The present invention is directed to an explosive composition comprised of Heavy ANFO and a plant-derived, inert bulking and sensitizing additive. The explosive composition is wet to the touch and, as a consequence, is not considered a "dry mix" explosive. In one embodiment, the inert bulking and sensitizing additive comprises hulls of a grain, where each of the hulls has a plurality of voids. In addition, the inert bulking and sensitizing additive is substantially devoid of any components of the grain other than the hulls. In one embodiment, the hulls are rice hulls.

In another embodiment, the inert bulking and sensitizing additive comprises hulls of a grain that are each characterized by a plurality of voids. Further the hulls are no longer naturally attached to any other components of the grain. In one embodiment, the hulls are rice hulls. In other embodiments, the composition is substantially devoid of components of the grain other than the hulls of the grain.

Yet a further embodiment of the invention is directed to a method for making a Heavy ANFO with a plant-derived, inert bulking and sensitizing additive. The method, in one embodiment, comprises the steps of: (a) providing a blender; (b) loading the blender with an emulsion explosive; (c) after the emulsion explosive has been added to the blender, loading the blender with an ammonium nitrate based explosive; (d) using the blender to blend the emulsion explosive and the ammonium nitrate based explosive to create a Heavy ANFO; and (e) using the blender to blend the Heavy ANFO with an inert bulking and sensitizing additive comprising hulls of a grain, the hulls each characterized by a plurality of voids. In one embodiment, the hulls of grain comprise rice hulls.

An additional embodiment of the invention is directed to a method for making an explosive composition comprised of Heavy ANFO and hulls of a grain. The method comprises providing an end-to-end level blender and then using the blender to blend Heavy ANFO and the hulls of a grain to produce an explosive composition with a highly homogenous consistency. In a further embodiment, the blender is also used to blend the constituents of Heavy ANFO.

One other embodiment of the invention is directed to a method for using an explosive composition comprised of Heavy ANFO and hulls of a grain. The method comprises providing an explosive composition comprising Heavy ANFO and hulls of a grain and loading the explosive composition into a blast hole. In other embodiments, the method comprises blending a Heavy ANFO and the hulls of grain to produce the explosive composition and doing the blending on the property on which the blast hole is located. Yet a further embodiment comprises performing a blending of a Heavy ANFO and the hulls of grain on a mobile platform.

DETAILED DESCRIPTION

The present invention is directed to an explosive composition comprised of Heavy ANFO and a plant-derived, inert bulking and sensitizing additive.

Heavy ANFO is comprised of an emulsion explosive in combination with ANFO and/or ammonium nitrate. The emulsion explosive is comprised of: (a) a disperse phase with an aqueous solution of one or more oxidizer salts; and (b) a continuous phase with an oil and an emulsifying additive. Suitable oxidizer salts include ammonium nitrate, sodium nitrate, and calcium nitrate. Other oxidizers known to those skilled art or set forth in the literature relating to explosives are also feasible, including but not limited to Urea, iron oxide, lead dioxide, ammonium perchlorate, barium nitrate, barium peroxide, lead tetroxide, potassium chlorate, potassium chlorate, potassium perchlorate, sodium perchlorate, etc. Generally, the oxidizer or oxidizers are concentrated in the aqueous solution and can be saturated in the aqueous solution. The oil is typically fuel oil or diesel oil or a combination thereof. However, other oils known to those skilled in the art or set forth in the literature relating to explosives are feasible, including but not limited to waste oil, bunker oil, and mineral oil. Potential substitutes for oil are coal dust and rubber. Any one of a number of emulsifying additives known to those skilled in the art and set forth in the literature relating to explosives are feasible. Many suitable emulsifiers are characterized as esters or other derivatives of monhydric or polyhydric alcohols that are combined with long chain components or other lyophilic materials.

A typical explosive emulsion used in Heavy ANFO is comprised of from about 40% to about 80% by weight ammonium nitrate; from about 0% to about 40% by weight calcium nitrate; from about 0% to about 15% sodium nitrate; from about 10% to about 25% by weight water; and from about 5% to about 12% by weight fuel oil.

ANFO is comprised of ammonium nitrate and fuel oil. Typically, the ammonium nitrate is in the form of porous ammonium nitrate prills. However, other forms of ammonium nitrate can be utilized to produce ANFO, including but not limited to agricultural grade ammonium nitrate prills, crystalline ammonium nitrate, and ground ammonium nitrate. However, these other forms of ammonium nitrate typically result in a lower quality ANFO relative to ANFO made with porous ammonium nitrate prills. If desired, some of the ammonium nitrate can be replace with one or more other oxidizers, such as those noted with respect to the emulsion explosive. Fuel oil as used herein refers to any liquid petroleum product that is burned in a furnace for the generation of heat or used in an engine for the generation of power. In addition, the term fuel oil comprises: (a) suitable substitutes for such liquid petroleum products, such as mineral oils, and (b) combinations of such liquid petroleum products and suitable substitutes.

The plant derived, inert bulking and sensitizing additive comprises hulls of a grain with a characteristic of the hulls being that they each have a plurality of voids, commonly referred to as micro-voids due to their small size. The micro-voids serve to create what are known as "hot spots" or void volumes that, all other factors remaining constant, increase the sensitivity of the explosive composition. The hulls also, all other factors remaining constant, decrease the density of the explosive composition. Consequently, the hulls serve both to decrease density and increase sensitivity. In one embodiment, the additive comprises the hulls but is substantially devoid of any portion of the grain other than the hulls. In another embodiment, the explosive composition comprises the hulls but is substantially devoid of any portion of the grain other than the hulls, i.e., no portion of the grain other than the hull serves another purpose within the explosive composition. In yet a further variation, the additive comprises the hulls from the grain and another component that serves to reduce the density and/or increase the sensitivity of the explosive that is approximately the same size as a hull.

One type of hull that has a plurality of micro-voids and is capable of acting as an inert bulking agent to reduce the density of the explosive composition is a rice hull. The micro-void characteristic of rice hulls is discussed in Chapter 19 of *Rice: Chemistry and Technology*, written by Bienvenido O. Juliano, which is incorporated herein by reference. Rice hulls also have a waxy coating that complements the water resistant characteristic of the Heavy ANFO.

However, any other type of hull that exhibits micro-voids and is capable of acting as an inert bulking agent is also feasible.

The ranges of the raw materials for an explosive composition comprised of Heavy ANFO and a plant-derived, inert bulking and sensitizing additive is set forth in Table I.

TABLE I

| Raw Materials | Min. % by weight | Max % by weight |
|---|---|---|
| Ammonium nitrate | 50 | 99 |
| Calcium nitrate | 1 | 20* |
| Sodium nitrate | 1 | 20* |
| Fuel phase | 1 | 10 |
| Water | 1.5 | 12 |
| Inert bulking agent | 1 | 25** |

*the combination of calcium nitrate and sodium nitrate has a maximum % of 20%
**% relative to final blend of Heavy ANFO and the hulls It should be noted that the composition set forth in Table II assumes that an emulsion explosive is being utilized that comprises at least calcium nitrate and sodium nitrate. As previously noted emulsion explosives with other compositions are feasible.

The ranges of the raw materials for an embodiment of an explosive composition comprised of Heavy ANFO and a plant-derived, inert bulking and sensitizing additive that has characteristics that approach those of ANFO are set forth in Table II.

TABLE II

| Raw Materials | Range ± 1% by weight |
|---|---|
| Ammonium nitrate | 75 |
| Calcium nitrate | 12* |
| Sodium nitrate | 12* |
| Fuel phase | 6.6 |
| Water | 6.6 |
| Inert Bulking Agent | 15** |

*the combination of calcium nitrate and sodium nitrate has a maximum % of 12%
**% relative to final blend of Heavy ANFO and the hulls The ranges of the raw materials for an embodiment of an explosive composition comprised of Heavy ANFO and a plant-derived, inert bulking and sensitizing additive that has characteristics that more closely approach those of ANFO is set forth in Table III.

TABLE III

More Preferred Constituents

| Raw Materials | Range ± 1% by weight |
|---|---|
| Ammonium nitrate | 75.23 |
| Calcium nitrate | 11.61* |
| Sodium nitrate | 11.61* |
| Fuel phase | 6.49 |
| Water | 6.58 |
| Inert Bulking Agent | 13.5** |

*the combination of calcium nitrate and sodium nitrate has a maximum % of 11.61%
**% relative to final blend of Heavy ANFO and the hulls Having described the explosive composition, a method for manufacturing the composition is now described. Generally, the explosive composition of a Heavy ANFO and a plant derived, inert bulking and sensitizing additive is formed in a blender. It is desirable to produce the explosive composition such that little mechanical stress is imparted to the constituents of the composition during the manufacturing process, but a high degree of homogeneity is achieved because this reduces the variability in the performance characteristics of the explosive composition. A mixer that has been found to be capable of producing the explosive composition with a high degree of homogeneity and to do so while causing little mechanical stress on the constituents of the composition is an end-to-end level blender. An example of such a blender is set forth in U.S. Pat. No. 4,506,990, which is incorporated herein by reference. Blenders that operate on similar principles to the blender set forth in the '990 patent are also feasible, as well as any blenders that are capable of achieving a high degree of homogeneity in the composition while subjecting the constituents of the composition to little stress during the manufacturing process. It should be appreciated that the explosive composition can be made and function as an explosive without having a high degree of homogeneity or having been subjected to little mechanical stress during the manufacturing process. However, if there is not a high degree of homogeneity and/or the composition is subject to significant mechanical stress during the manufacturing process the performance characteristics of the resulting composition are subject to a greater degree of variability.

The blender is implemented on a mobile platform to allow the explosive composition to be blended on the blast site and then transported between the various blast holes at the site. The blender is also equipped with directable chute, sleeve or auger that allows the explosive composition to be dispersed into the blast holes. It should be appreciated that the blender can be implemented on a stationary platform and then transferred to a mobile vehicle for transport to the blast holes. However, the transfer operation subjects the explosive to unnecessary mechanical stress that may adversely affect the performance of the composition.

Regardless of the type of blender that is utilized, the explosive composition is formed by blending Heavy ANFO and the plant derived, inert bulking and sensitizing additive comprised of hulls of grain with each of the hulls having a plurality of voids. More specifically, the inert bulking and sensitizing additive is added to Heavy ANFO that is present in the blender and blended with the Heavy ANFO. The blending is terminated when it appears that the hulls are substantially evenly distributed between the Heavy ANFO particles.

The Heavy ANFO in the blender can be produced at a different location and then loaded into the blender. However, in many cases, it is desirable to produce the Heavy ANFO in the same blender that is used to blend the Heavy ANFO with the bulking and sensitizing additive. In this case, the production of the explosive composition commences with the loading of an emulsion explosive into the blender. The emulsion explosive has a bulk density from about 1.26 gm/cc to about 1.50 gm/cc, an oxygen balance from about 7.5 to about 1.0. The emulsion explosive also has from about 10% to about 25% by weight water. The blender is typically not operative during the loading of the emulsion explosive.

After the emulsion explosive has been loaded into the blender, ANFO and/or ammonium nitrate is loaded into the blender. Typically, the blender is not operative during the loading of the ANFO and/or ammonium nitrate. At least in the case of an end-to-end level blender, the ANFO and/or ammonium nitrate is loaded such that it is on top of the previously loaded emulsion explosive. This reduces the mechanical stress placed on the ANFO and/or ammonium nitrate when the blender is activated because the rotors of the blender have been lubricated by the emulsion explosive.

After the ANFO and/or ammonium nitrate has been loaded into the blender, the blender is activated to blend the emulsion explosive with the ANFO and/or ammonium nitrate and thereby manufacture Heavy ANFO. In the case of an end-to-end level blender, the blending takes approximately two minutes. The Heavy ANFO has a bulk density from about 1.0 gm/cc to about 1.45 gm/cc. Heavy ANFO with a bulk density in this range, and especially with respect to the upper end of the range, is generally consider to be too dense to reliably detonate in certain applications.

After the Heavy ANFO has been produced, the inert bulking and sensitizing agent comprised of hulls that have voids is added to the Heavy ANFO in the blender and blended as described above. The blending of the additive with the Heavy reduces the bulk density of the explosive composition. Depending upon the amount of additive utilized, the resulting explosive composition has a bulk density from about 0.35 gm/cc to about 1.33 gm/cc. When an end-to-end level blender is used, blending of the Heavy ANFO followed by the blending of the Heavy ANFO with the inert bulking and sensitizing additive typically requires 4 to 12 minutes to complete.

The explosive composition is used in mining operations by loading the composition one or more blast holes together with an appropriate detonating device. Typically, the detonating device is loaded into a blast hole prior to the loading of the explosive composition into the blast hole. A blast engineer determines the amount of explosive that is to be loaded into each hole and a weighing system on the vehicle that transports the composition to the blast hole or holes is used to load the appropriate amount of the explosive composition in each hole. As previously, the explosive composition can be manufactured on the blast site. Further, the explosive composition can be manufactured on site and on a mobile vehicle that can then be used to transport the composition to the blast hole or holes.

What is claimed is:

1. A method for using an explosive in a mining operation comprising:

providing an explosive composition comprising Heavy ANFO and rice hulls that are each substantially devoid of components of rice other than a rice hull; and loading said explosive composition into a blast hole that has been established in the earth.

2. A method, as claimed in claim 1, wherein:

said step of providing comprises blending a Heavy ANFO and rice hulls.

3. A method, as claimed in claim 2, wherein:

said step of blending comprises blending said Heavy ANFO and rice hulls on the same property as said blast hole is located.

4. A method, as claimed in claim 2, wherein:

said step of blending comprises blending Heavy ANFO and rice hulls on a mobile platform.

* * * * *